United States Patent [19]

Kierce

[11] Patent Number: 4,644,604

[45] Date of Patent: Feb. 24, 1987

[54] ROLLER PAINT APPLICATOR FOR WROUGHT IRON RAILING

[76] Inventor: Jack W. Kierce, 4656 La Cuenta Dr., San Diego, Calif. 92124

[21] Appl. No.: 766,518

[22] Filed: Aug. 19, 1985

[51] Int. Cl.[4] ..... B05C 17/02; B05C 1/08

[52] U.S. Cl. ..... 15/244 A; 15/230.11; 401/10

[58] Field of Search ..... 401/9, 10; 15/230.11, 15/210 A, 244 A

[56] References Cited

U.S. PATENT DOCUMENTS

| | | | |
|---|---|---|---|
| 741,722 | 10/1903 | Ryder et al. | 15/167 |
| 1,111,144 | 9/1914 | Epstein et al. | 15/167 |
| 1,546,322 | 7/1925 | Solary | 15/167 |
| 2,788,539 | 4/1957 | Santina | 15/230.11 |
| 2,799,884 | 7/1957 | Bedford | 15/230.11 |
| 2,813,292 | 11/1957 | McLendon | 15/230.11 |
| 2,824,328 | 2/1958 | Bedford | 15/230.11 |
| 2,848,730 | 8/1958 | Billings | 15/230.11 |
| 2,896,243 | 7/1959 | Schoenfield et al. | 15/230.11 |
| 2,904,813 | 9/1959 | Schleicher | 15/230.11 |
| 3,205,526 | 9/1965 | Archibald | 15/244 |
| 3,340,131 | 9/1967 | Leibow | 15/230.11 |
| 3,358,312 | 12/1967 | Parr | 15/230.11 |
| 3,430,286 | 3/1969 | Bownes | 15/230.11 X |
| 4,335,484 | 6/1982 | Ridge et al. | 15/230.11 |

FOREIGN PATENT DOCUMENTS

| | | | |
|---|---|---|---|
| 359325 | 1/1906 | France | 15/210 A |
| 1390356 | 1/1965 | France | 15/230.11 |
| 1427399 | 12/1965 | France | 15/230.11 |
| 2232188 | 12/1974 | France | 15/230.11 |

*Primary Examiner*—Steven A. Bratlie

*Attorney, Agent, or Firm*—Loyal M. Hanson

[57] ABSTRACT

A paint applicator is disclosed that employs a pair of elongated prongs, each prong having a roller end on which a paint roller is rotatably mounted, and a handle end that is movably connected to the handle end of the other prong. The prongs are spring biased in side-by-side relation with the rollers slightly spaced apart so that manually squeezing the prongs together enables one-handed flexing of the rollers against a section of railing to be painted. Sponge rubber rollers may be employed that conform to the shape of the railing.

11 Claims, 4 Drawing Figures

ROLLER PAINT APPLICATOR FOR WROUGHT IRON RAILING

BACKGROUND OF THE INVENTION

This invention relates in general to paint applicators and particularly to a roller applicator that is suitable for painting wrought iron railing.

The right tool for the job achieves efficiency and superior results, and nowhere is this principle more applicable than in painting. One painting job that can be particularly tedious, time consuming, and likely to frustrate a painter, is the job of painting railing such as the wrought iron railing that adorns many of our homes. This job involves painting the many relatively narrow surfaces of closely spaced rails in a repetitive sequence of carefully applied strokes, and so a specially designed paint applicator is called for. The right paint applicator would reduce the time and concentration otherwise required, and although many types and kinds of paint applicators exist, none are quite the right tool for painting wrought iron railing.

A typical section of wrought iron railing consists of a series of spaced apart rails extending perpendicularly between generally parallel top and bottom rails. Each of these rails may employ a variety of shapes, generally rectangular shapes and serpentine shapes being common. Each of these different shapes produces it own unique and attractive railing design, but at the same time it results in a great number of relatively narrow and closely spaced surfaces to which paint must be applied. Painting the railing involves applying paint to each one of these surfaces, and this requires a series of carefully applied, repetitive strokes that expend time and concentration.

Spray painting has been used in the past in an attempt to overcome this problem, but this has often had undesired results. The typical wrought iron railing installation is in close proximity to other objects such as buildings and shrubbery, and spray painting risks undesired painting of these nearby objects. Either that or the objects must be adequately masked with drop cloths or old newspapers. Consequently, it is desirable to have a paint applicator that reduces this risk and eliminates the related requirement of masking nearby objects.

In addition to spray painting, small conventional paint brushes have been used in the past in an attempt to simplify this type of painting job, but this does not significantly reduce the number of strokes, skill, or concentration required. The opposite approach, using an excessively large conventional paint brush and more paint in a slap-it-on approach, is in some respects less tedious, but the results are correspondingly less professional. Consequently, it is desirable to have a paint applicator that reduces the number of strokes, skill, and concentration required in painting wrought iron railing while still enabling a painter to achieve quality results.

Although roller paint applicators exist for some painting jobs, none of these are suited to the relatively detailed work of painting wrought iron railing. Existing roller applicators are designed for painting long flat surfaces in correspondingly long flat strokes. Some require two-handed operation, and others are totally unsuited for railing having a serpentine shape. Thus, it is desirable to have a paint applicator that can be used conveniently with one hand, and that is suitable for painting the twisted shape of serpentine railing.

SUMMARY OF THE INVENTION

Therefore, it is an object of this invention to provide a new and improved paint applicator with the desired attributes for painting railing such as wrought iron railing, and it is an object to provide a roller paint applicator that is conveniently operable with one hand.

The above and other objects of the invention are realized by a device comprising a pair of elongated prongs to which a pair of rollers are attached. Each prong has a handle end and a roller end, with the handle ends being interconnected and each one of the rollers being rotatably mounted on the roller end of a corresponding one of the prongs. Spring-biasing components are provided both for spring biasing the prongs in side-by-side relation with the rollers slightly spaced apart, and for enabling the rollers to be flexed together against a section of railing by manually squeezing the prongs together.

One embodiment employs a V-shaped spring handle member of unitary wire construction that can be grasped and squeezed with one hand to flex the rollers together. The rollers are composed of a soft spongy material that deforms when flexed against a section of railing, thereby encircling the railing so that paint is applied simultaneously all the way around.

BRIEF DESCRIPTION OF THE DRAWINGS

The above and other objects and advantages of the invention will become more apparent upon reading the detailed description in conjunction with the accompanying drawings.

DETAILED DESCRIPTION

Figure 1:
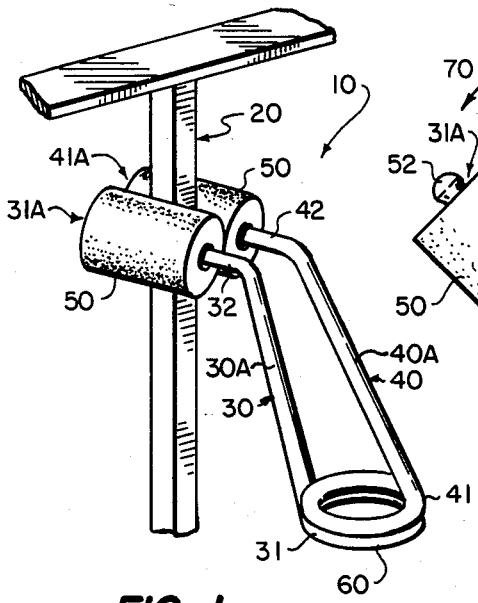
FIG. 1 of the drawings in a perspective view of a paint applicator constructed in accordance with the invention shown in a painting position on a section of wrought iron railing.
Figure 2:
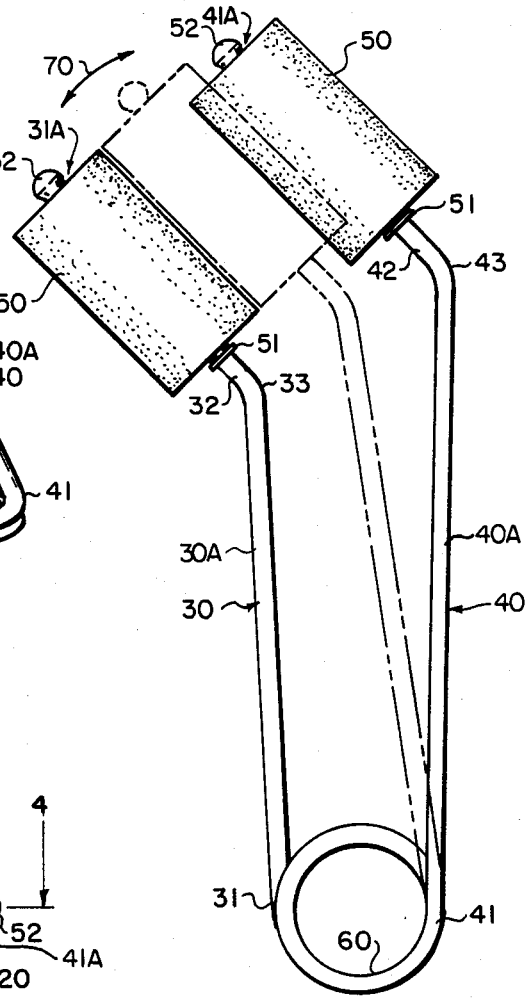
FIG. 2 is a plan view of the paint applicator with phantom lines showing the rollers flexed together.

Referring now to the drawings, and particularly to FIGS. 1 and 2, there is shown a paint applicator constructed in accordance with the invention. It is referred to generally by reference numeral 10 and shown in FIG. 1 in a painting position against railing 20.

Applicator 10 includes a first handle member, prong 30, extending between handle end 31 and roller end 31A. The prong 30 includes a handle portion 30A extending from handle end 31 to bend 33, and a bent or offset portion 32 extending from bend 33 to roller end 31A that offsets roller alignment. Applicator 10 includes a second handle member, prong 40, extending between handle end 41 and roller end 41A. As illustrated, the prong 40 extends outwardly from the handle ends with prong 30 generally in a common plane and in a common direction (the gripping axis), and it includes a handle portion 40A extending from handle end 41 to bend 43, and a corresponding bent or offset portion 42 extending from bend 43 to roller end 41A.

In the illustrated embodiment, these prongs are composed of three-sixteenths inch spring wire, and they are each about one foot long. Other generally rigid handle members may be employed. The bent portions offset the rollers so that they are not in line with the longitudinal axis of the corresponding prong and, hence, out of line with a user's grip. This results is a more convenient positioning of the rollers relative to the user's hand when the paint applicator is stroked back and forth on a section of railing.

Rotatably mounted rear the roller end of each offset portion of the prongs is a roller 50. Each of the rollers is held in place with bearing collars 51 and push-on caps 52, both of which employ a force fit to hold them in place. The illustrated rollers are one and one-half inch diameter foam rubber members that are cyclindrically shaped. Other material can be used so long as the rollers can retain enough paint to enable transfer of paint from a container to the railing being painted, and so long as they can deform sufficiently to partially encircle the railing.

The handle ends of the prongs, handle ends 31 and 41, are movably connected together by suitable means. The illustrated embodiment employs a midpotion bend in the spring wire that extends from one handle end to the other to define the illustrated helically-shaped loop 60. This loop serves also as spring biasing means for maintaining the prongs in diverging positions (as shown in FIG. 2) such that the rollers are slightly spaced apart in side-by-side relation. This position allows the rollers to be placed on opposing sides of railing 20 in position for applying paint to the railing.

The spring biasing is such as to enable the rollers to be flexed together against the railing by manually squeezing the prongs together. Thus, by grasping the prongs and squeezing them together, the rollers flex together as indicated by arrow 70 (FIG. 2).

Other means of connecting the handle ends together, such as a hinge, may be employed within the inventive concepts herein disclosed, along with other means of spring biasing the prongs, such as a spring. The unitary wire construction of the illustrated embodiment is especially useful in combining these functions in loop 60.

Figure 3:
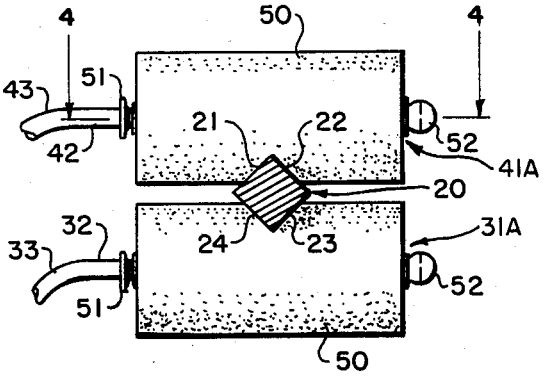
FIG. 3 shows details of the rollers flexed against the railing.

FIG. 3 illustrates the manner in which the rollers encircle the railing being painted. The illustrated railing is generally square in cross-section, thereby defining four surfaces 21–24. When flexed together, the rollers come in contact with the railing and deform so that one of the rollers contacts both surfaces 21 and 22 while the other one of the rollers contacts both surfaces 23 and 24. Thus, paint can be applied all the way around the periphery of the railing by rolling the paint applicator of this invention back and forth in a few easy strokes.

This feature also facilitates painting of more complex shapes, such as serpentine railing. The rollers deform to encircle the railing as the applicator is moved back and forth while being squeezed against the railing. Thus, the skill and concentration normally required for carefully-applied repetitive strokes are avoided.

Figure 4:
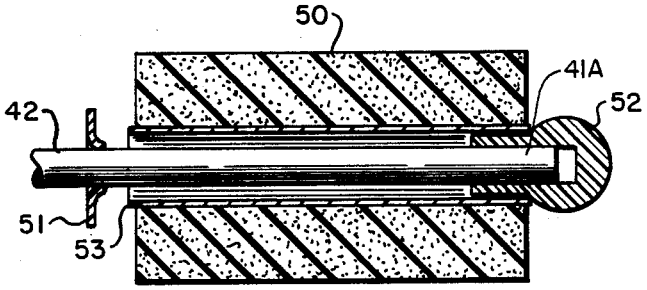
FIG. 4 is a sectional view taken on line 4—4 of FIG. 3.

Further details of the rollers are shown in FIG. 4. Bushing 53 is a plastic tube that extends axially down the center of roller 50. Other suitable bushings may be employed to enable roller 50 to rotate on the roller end of the prong. Bearing collar 51 and push-on cap 52 bear against the bushing to retain the roller in position on the end of the prong.

In operation, the paint applicator is grasped with one hand and either dipped or rolled in paint that is to be applied to the railing. The rollers are then placed on opposite sides of a section of railing, with the prongs being manually squeezed so that the rollers flex together against the section of railing. Then, with a series of back-and-forth strokes, the paint is rolled onto the railing. Just enough pressure is applied to the prongs to deform the rollers around the railing so that paint is simultaneously applied all the way around. The grip on the prongs is then relaxed, the applicator is withdrawn from the railing, and the process is repeated.

Thus, the paint applicator of this invention enables one-handed operation that avoids the careful repetitive strokes and related skill and concentration otherwise required in painting wrought iron railing.

The paint applicator comprises a pair of elongated prongs and a pair of rollers. Each prong has a roller end on which one of the rollers is rotatably mounted, and a handle end that is movably connected to the handle end of the other prong. Spring-biasing means position the prongs in side-by-side relation with the rollers slightly spaced apart, while enabling the rollers to be flexed together against a selected section of railing by manually squeezing the prongs together.

Prongs 30 and 40 are connected by loop 60 in the illustrated V-shaped spring handle member. This unitary construction may be replaced with separate prongs that are suitably connected together and spring-biased. Other modifications may be made within the inventive concepts herein disclosed while retaining the essential features that make this roller paint applicator the right tool for the job.

As various changes may be made in the form, construction, and arrangement of the procedures and parts described herein, without departing from the spirit and scope of the invention and without sacrificing any of its advantages, all matter herein is to be interpreted as illustrative and not in any limiting sense.

What is claimed is:

1. A device suitable for painting wrought iron railing, which comprises:

a pair of elongated prongs, each one of the prongs having a handle end and a roller end;

a pair of generally straight handle portions of the prongs, each one of the handle portions extending from the handle end of a respective one of the prongs to an offset bend of the respective prong;

a pair of generally straight offset portions adapted to rotatably receive a pair of rollers, each one of the offset portions extending from the offset bend of a respective one of the prongs to the roller end of the respective prong;

connecting means for connecting the handle ends of the prongs together, both so that the handle portions extend outwardly from the handle ends generally in a common plane and in a common direction that defines a gripping axis, and so that the offset portions extend outwardly from the handle portions generally in said common plane and in a common offset direction that is offset from the gripping axis; and spring-biasing means both for spring biasing the prongs in side-by-side relation with the offset portions slightly spaced apart, and for enabling a pair of rollers mounted on the offset members to be flexed together against a selected section of railing by manually squeezing the prongs together to enable a user to squeeze the handle portions, with a section of railing between a pair of rollers mounted on the offset portions, the back of the user's hand generally parallel to said common plane, and the gripping axis offset from the rotational axes of the rollers, while the rollers are moved along the section of railing in a direction generally perpendicular to said common plane.

2. A device as recited in claim 1 which includes:

a V-shaped spring handle member defining two diverging prongs.

3. A device as recited in claim 2 wherein the V-shaped spring handle member is of unitary construction.

4. A device as recited in claim 2 wherein the V-shaped spring handle member comprises a length of resilient material.

5. A device as recited in claim 2 wherein the V-shaped spring handle member comprises a length of wire.

6. A device as recited in claim 1, further comprising:

offsetting means for offsetting a rotational axis associated with each of the rollers from a gripping axis associated with a user of the device.

7. The device recited in claim 1, further comprising:

a handle member of unitary construction adapted to be held with one hand, the handle member being composed of a length of resilient wire having a center portion shaped to form a loop of at least one full turn and two end portions shaped to define two prongs extending from the center portion.

8. The device recited in claim 1, wherein the roller are composed of a flexible material that enables the rollers to conform to the periphery of a section of railing against which the rollers are flexed.

9. The device recited in claim 8, wherein the flexible material is sponge rubber.

10. A painting device, comprising:

a wire handle of unitary construction composed of a wire having a series of bends;

a midportion bend in the wire defining a helically-shaped loop of at least one turn and a pair of spaced-apart, generally straight prong portions of the wire that extend outwardly from the loop generally in a common plane and in a common prong direction that defines a gripping axis of the handle member;

the loop and the prong portions defining a manually-grippable portion of the handle portion to be gripped by a user of the painting device;

a pair of offset bends in the wire, each one of the offset bends being located at a distal end of a respective one of the two prong portions to define a pair of spaced-apart offset portions of the wire that extend outwardly from respective ones of the prong portions generally in said common plane and in a common offset direction that is offset from the gripping axis;

a pair of axle portions of the offset portions upon which to rotatably mount a pair of paint rollers in slightly spaced-apart positions with their axes of rotation disposed in said common plane; and a pair of rollers, each one of the rollers adapted to be rotatably mounted on a respective one of the axle portions;

the loop cooperating with the prong portions both to spring bias the prongs in side-by-side relation with a pair of rollers mounted on the axle portions slightly spaced apart, and to enable the rollers to be flexed together against a selected section of railing to be painted by manually squeezing the prongs together with one hand; and the prong portions cooperating with the offset portions to enable a user to grip the manually-grippable portion, with a section of railing between the rollers, the back of the user's hand generally parallel to said common plane, and the gripping axis offset from the rotational axes of the rollers, while the painting device is moved along the section of railing in a direction generally perpendicular to said common plane.

11. A painting device, comprising :

a wire handle of unitary construction composed of a wire having a midportion bend and a pair of offset bends;

the midportion bend in the wire defining a helically-shaped loop of at least one turn and a pair of spaced-apart, generally straight prong portions of the wire that extend outwardly from the loop generally in a common plane and in a common prong direction that defines a gripping axis of the handle member;

the loop and the prong portions defining a manually-grippable portion of the handle portion to be gripped by a user of the painting device;

each one of the pair of offset bends being disposed in the wire at a distal end of a respective one of the prong portions to define a pair of spaced-apart offset portions extending outwardly from the respective prong portions generally in said common plane and in a common offset direction that is offset from the gripping axis; and a pair of paint rollers rotatably mounted on respective ones of the offset portions;

the loop spring biasing the prongs in side-by-side relation with the rollers slightly spaced apart to enable the pair of rollers to be squeeze together against a selected section of railing to be painted by manually squeezing the prongs together with one hand; and the prong portions offsetting the gripping axis from the rotational axes of the pair of rollers to enable the rollers to be moved along a section of railing in a direction generally perpendicular to said common plane with the handle portion offset from the offset direction.

* * * * *